US010648060B2

(12) United States Patent
Jaatinen et al.

(10) Patent No.: US 10,648,060 B2
(45) Date of Patent: May 12, 2020

(54) FIRE REFINING OF BLISTER COPPER

(71) Applicant: OUTOTEC (FINLAND) OY, Espoo (FI)

(72) Inventors: Akusti Jaatinen, Espoo (FI); Harri Talvensaari, Nummela (FI)

(73) Assignee: OUTOTEC (FINLAND) OY, Espoo (FI)

( * ) Notice: Subject to any disclaimer, the term of this patent is extended or adjusted under 35 U.S.C. 154(b) by 175 days.

(21) Appl. No.: 15/570,831

(22) PCT Filed: May 3, 2016

(86) PCT No.: PCT/FI2016/050281
§ 371 (c)(1),
(2) Date: Oct. 31, 2017

(87) PCT Pub. No.: WO2016/177936
PCT Pub. Date: Nov. 10, 2016

(65) Prior Publication Data

US 2018/0142323 A1 May 24, 2018

(30) Foreign Application Priority Data

May 6, 2015 (FI) ..... 20155329

(51) Int. Cl.
*C22B 15/00* (2006.01)
*C22B 9/05* (2006.01)

(52) U.S. Cl.
CPC ..... *C22B 15/006* (2013.01); *C22B 9/05* (2013.01); *C22B 15/003* (2013.01); *C22B 15/0028* (2013.01)

(58) Field of Classification Search
CPC . C22B 15/006; C22B 15/0028; C22B 15/003; C22B 9/05; C22B 5/00
See application file for complete search history.

(56) References Cited

U.S. PATENT DOCUMENTS 4,830,667 A 5/1989 Marcuson et al.
6,403,043 B1 6/2002 Utigard et al.
(Continued)

FOREIGN PATENT DOCUMENTS

CA 1322659 * 10/1993
CN 1390962 A 1/2003
(Continued)

OTHER PUBLICATIONS

JP-02070026-A machine translation (Year: 1990).*
(Continued)

*Primary Examiner* — Tima M. McGuthry-Banks
(74) *Attorney, Agent, or Firm* — Buchanan, Ingersoll & Rooney PC

(57) ABSTRACT

Provided herein is a process of fire refining blister copper, comprising the steps of (a) providing molten blister copper into an anode furnace; (b) when sulfur concentration of the molten blister copper provided in step (a) is above a first prescribed target value, oxidizing sulfur in the molten blister copper by blowing oxygen containing gas into the molten blister copper until the first prescribed target value has been reached; (c) subsequently lowering the sulfur and oxygen content in blister copper by blowing inert gas into the molten blister copper until a second prescribed target value has been reached, wherein the inert phase (c) is continued until the second prescribed target value of the oxygen concentration is below 4000 ppm, and the second prescribed target value of the sulfur concentration is below 500 ppm; (d) when certain condition(s) occur, subsequently reducing oxygen in the blister copper; and (e) optionally casting.

16 Claims, 3 Drawing Sheets

(56) References Cited

U.S. PATENT DOCUMENTS

| | | | |
|---|---|---|---|
| 2012/0036963 | A1 | 2/2012 | George et al. |
| 2014/0102257 | A1 | 4/2014 | George et al. |

FOREIGN PATENT DOCUMENTS

| | | | | |
|---|---|---|---|---|
| CN | 101314819 | A | | 12/2008 |
| DE | 38 09 477 | A1 | | 10/1988 |
| JP | 02070026 | A | * | 3/1990 |
| WO | WO 99/46414 | A2 | | 9/1999 |
| WO | 2006/029162 | A1 | | 3/2006 |
| WO | WO 2011/103132 | A1 | | 8/2011 |

OTHER PUBLICATIONS

Search Report issued by the Finnish Patent and Registration Office in corresponding Finnish Patent Application No. 20155329 dated Dec. 9, 2015 (2 pages).

International Search Report (PCT/ISA/210) dated Jul. 4, 2016, by the Finnish Patent Office as the International Searching Authority for International Application No. PCT/FI2016/050281.

Notification of Transmittal of the International Preliminary Report on Patentability (PCT/IPEA/409) dated Jun. 16, 2017, by the Finnish Patent Office as the International Searching Authority for International Application No. PCT/FI2016/050281.

* cited by examiner

FIRE REFINING OF BLISTER COPPER

FIELD OF THE INVENTION

The invention relates to fire refining of blister copper and more particularly to a process of fire refining blister copper in three phases.

BACKGROUND OF THE INVENTION

Blister copper produced in converters or direct to blister furnaces must be purified of sulfur and oxygen before it can be cast to anodes. This is done in anode furnaces (AF) in a process known as fire refining.

Typically fire refining of blister copper is performed in two phases, oxidation phase and reduction phase. In oxidation phase air is blown to the blister copper and oxygen comprised in the air oxidizes sulfur to gaseous sulfur dioxide. Some of the oxygen also dissolves in the molten blister copper at the oxidation phase. The dissolved oxygen is removed in a reduction phase where a reductant, such as natural gas, is blown in the oxidized blister copper.

In order to achieve good quality anode copper for anode casting, sulfur concentration of the blister copper must be decreased to below 50 ppm. However, for achieving the required sulfur concentration a rapid increase of dissolved oxygen in the blister copper is induced at the end of the oxidation phase. This leads to copper losses to slag and to prolonged reduction phase causing high reductant consumption.

CN101314819B proposes a one phase fire refining process, wherein argon, industrial nitrogen, saturated steam or mixture thereof is blown in the copper and oxidation and reduction phases are omitted.

BRIEF DESCRIPTION OF THE INVENTION

An object of the present invention is to provide a process for fire refining of blister copper so as to overcome the above problems relating to over oxidation of the blister copper during fire refining. The objects of the invention are achieved by a process which is characterized by what is stated in the independent claims. The preferred embodiments of the invention are disclosed in the dependent claims.

The invention is based on the realization that blowing of inert gas, such as nitrogen avoids over oxidation of the blister copper and minimizes reductant use when refining of blister copper having lowered sulphur concentration. The present process improves energy efficiency of the fire refining of blister copper and decreases copper losses to anode furnace slag leading to lower internal copper circulation in the smelter. All pollution associated with the reduction phase is also reduced.

BRIEF DESCRIPTION OF THE DRAWINGS

In the following the invention will be described in greater detail by means of preferred embodiments with reference to the attached drawings, in which.

DETAILED DESCRIPTION OF THE INVENTION

The present invention provides a process of fire refining blister copper, comprising the steps of:

(a) providing molten blister copper into an anode furnace;

(b) when sulfur concentration of the molten blister copper provided in step (a) is above a first prescribed target value, oxidizing sulfur in the molten blister copper by blowing oxygen containing gas into the molten blister copper until the first prescribed target value has been reached;

(c) subsequently lowering the sulfur and oxygen content of the blister copper by blowing inert gas into the molten blister copper until a second prescribed target value has been reached, wherein the inert phase (c) is continued until the second prescribed target value of the oxygen concentration is below 4000 ppm, and the second prescribed target value of the sulfur concentration is below 500 ppm;

(d) when sulfur and/or oxygen, in particular oxygen, concentration of the molten blister copper obtained in step (c) is above a third prescribed target value, subsequently reducing oxygen in the blister copper by supplying a reducing agent into the molten blister copper until the third prescribed target value has been reached and anode copper is obtained; and (e) optionally casting the obtained anode copper.

Figure 1:
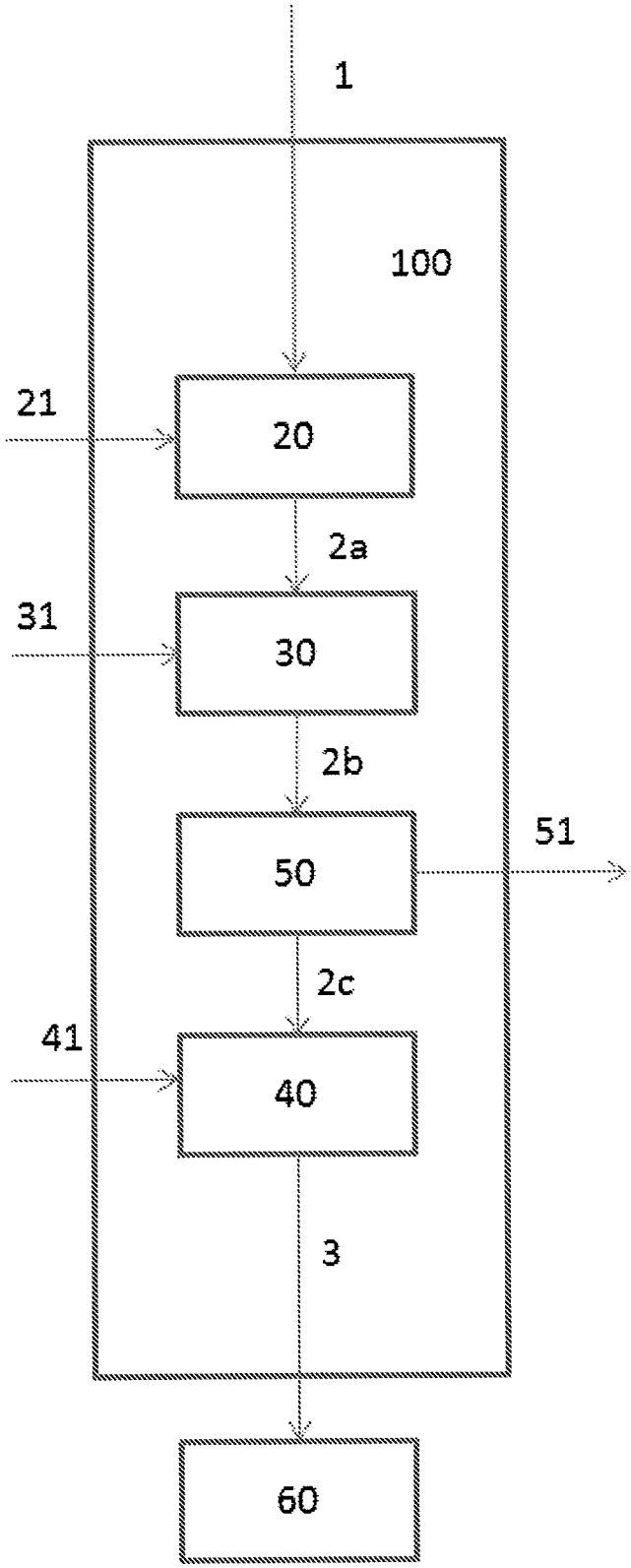
FIG. 1 is a flow diagram of a first example of the present process.
Figure 2:
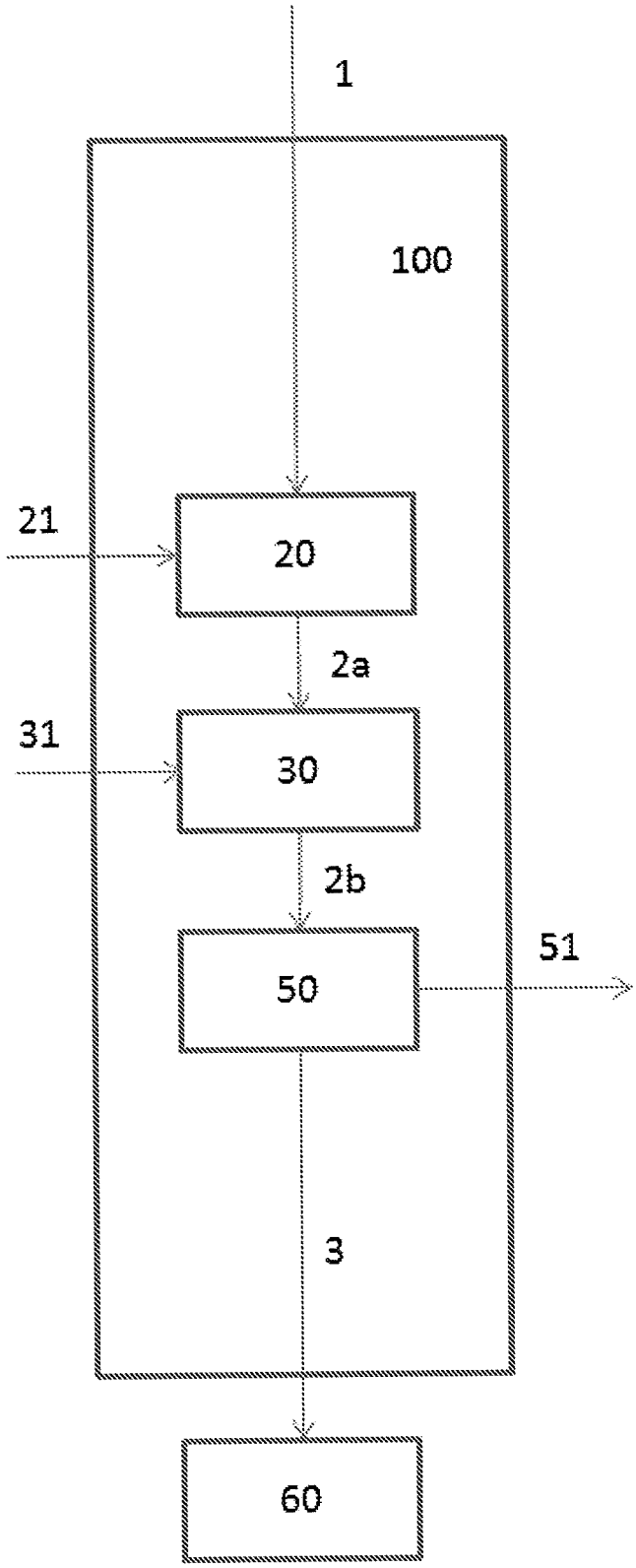
FIG. 2 is a flow diagram of a second example of the present process.
Figure 3:
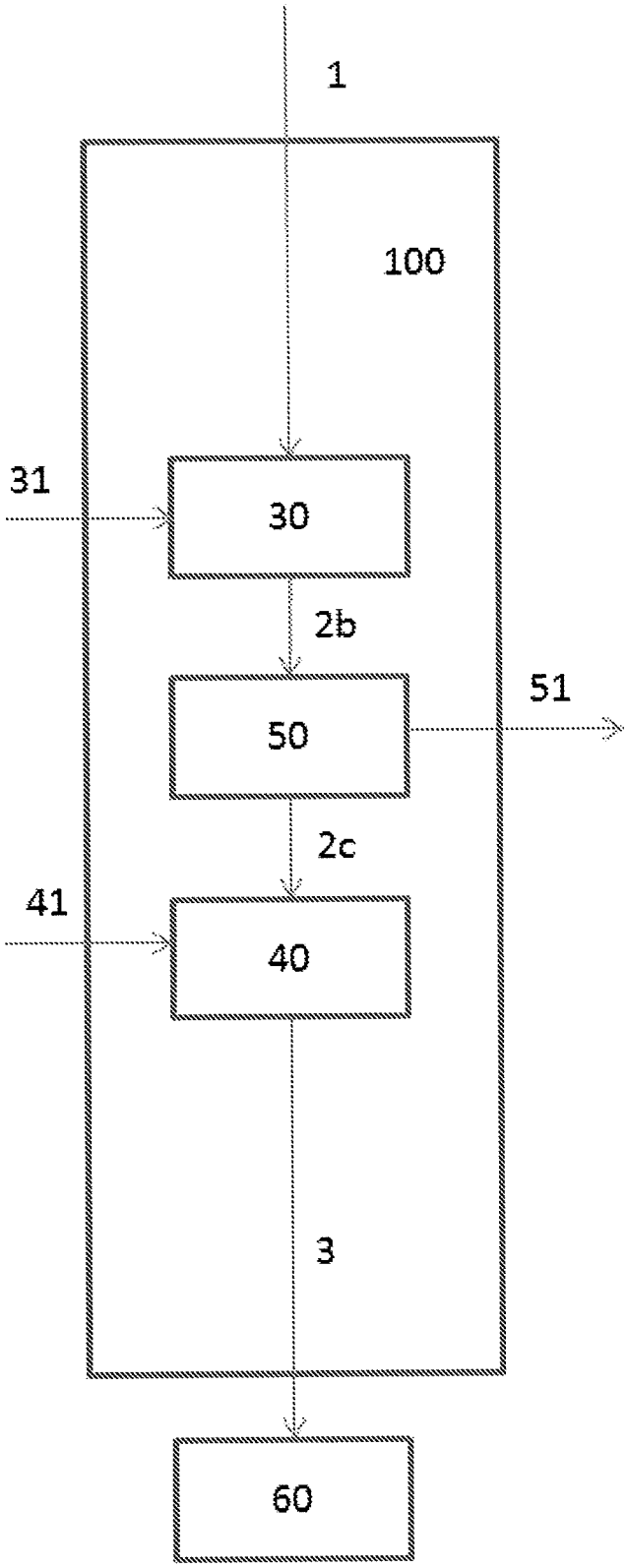
FIG. 3 is a flow diagram of a third example of the present process.

With reference to FIGS. 1, 2 and 3 illustrating alternative exemplary process flows of processes in accordance with the present invention, molten blister copper 1 is provided to an anode furnace (100), wherein it is subjected to fire refining. FIG. 1 illustrates as a first example a full three phase process comprising oxidative phase 30 of step (b), inert phase 40 of step (c), and reductive phase 40 of step (d). In accordance with the present process it may not be necessary and/or optimal to go through all three phases of steps (b), (c) and (d) of the process. In particular cases performance of only two phases suffices and only two of steps (b), (c) and (d) may be performed. However, in accordance with the present process, step (c) is always performed. FIG. 2 illustrates as a second example an exemplary process wherein reductive phase 40 of step (d) is omitted and FIG. 3 illustrates as a third example an alternative exemplary process wherein oxidative phase 20 of step (b) is omitted. All the phases of step (b), (c), and (d) included in respective processes are performed within the same anode furnace by alternating the process conditions.

In step (b) 20 of the present process oxygen containing gas 21 such as oxygen, oxygen enriched air, or air, is injected into the impure liquid metal, the molten blister copper. The impurities, in particular sulfur, oxidize before the metal and are removed as an oxide slag or a volatile oxide gas.

In this first phase, step (b)—oxidation phase 20—most of the sulfur contained in the molten blister copper is removed. As a result of direct blister or flash converting process the blister copper usually contains 1000 to 5000 ppm of sulfur. The oxidation phase is continued for a prescribed period of time causing the sulfur concentration in the blister copper to approach a first prescribed target value. As a result of oxidation phase of step (b) 20 the blister copper 2*a* usually contains at the initiation of inert phase 2000 to 5000 ppm, in particular 2100 to 3100 ppm of dissolved oxygen.

After the oxidation phase, the sulfur concentration of the blister copper 2*a* is desirably decreased to a target level from 200 ppm to 2000 ppm, preferably from 400 to 1000 ppm sulfur.

When the first prescribed target value of the blister copper 2*a* has been reached, step (c) of the present process is initiated. At the initiation of step (c) blowing of an inert gas 31, such as argon, steam, nitrogen, or helium, is initiated and the blowing of the oxygen containing gas is discontinued. Preferably the inert gas 31 is nitrogen. Inert gas 31 can be blown into the blister copper using the same equipment as for oxygen containing gas.

In this second phase, step (c)—inert phase 30—both sulfur and oxygen contained in the molten blister copper are being removed. The inert phase 30 is continued for a prescribed period of time causing the oxygen and sulfur concentration in the blister copper to approach a second prescribed target value. After the inert phase, the oxygen concentration of the blister copper 2*b* is desirably decreased to a target level below 4000 ppm, typically from 1500 to 2500 ppm, preferably from 2000 to 2300 ppm oxygen. After the inert phase, the sulfur concentration of the blister copper 2*b* is desirably decreased to a level below 500 ppm, typically below 200 ppm, preferably from 75 to 150 ppm sulfur.

Some slag forms during the oxidation and inert phases and slag removal 50 is typically performed at the end of the oxidation phase (b) and/or inert phase (c), preferably after the inert phase (c). In slag removal the anode furnace 100 is typically rotated about its longitudinal axis so that the slag 51 may be removed through the mouth of the furnace while blister copper 2*c* is retained in the anode furnace 100.

To obtain blister copper of anode purity 3 step (d) is initiated by introduction of a reducing agent 41 and discontinuation of the blowing of the inert gas 31 as the second prescribed target value has been reached. The reducing agent 41 may be any conventional reducing agent utilized in the reduction phase of conventional fire refining processes including a reducing gas, such as hydrogen, natural gas, a hydrocarbon, liquefied petroleum gas, heavy oil, diesel oil, pulverized coal, carbon monoxide and ammonia, or any mixture thereof. The reducing agent 41 may also be a mixture comprising hydrocarbon and air. As a result the blister copper is deoxygenated.

In the third phase, step (d)—reduction phase 40—the oxygen level of the blister copper is adjusted to an optimal level for electrolytic refining and thus anode copper 3 is obtained. The reduction phase is continued for a prescribed period of time causing the oxygen concentration in the blister copper to approach a third prescribed target value. After reduction, the target oxygen level of the anode copper 3 is below 3000 ppm, typically below 2300 ppm, preferably from 500 to 1500 ppm. During reduction, the sulfur concentration of the anode copper 3 is also decreased to a target level below 50 ppm.

As exemplified in FIG. 2, when sulfur and/or oxygen, in particular oxygen, concentration of the molten blister copper 2*b* obtained in step (c) is below the third prescribed target value, preferably below 3500 ppm, more preferably below 3000 ppm, reduction phase 40 of step (d) may be omitted and only oxidation phase 20 of step (b) and inert phase 30 of step (c) are performed.

Alternatively, when sulfur concentration of the molten blister copper 1 provided in step (a) is below the first prescribed target value, preferably below 2000 ppm, more preferably below 1000 ppm, oxidation phase 20 of step (b) may be omitted and only inert phase 30 of step (c) and reduction phase 40 of step (d) are performed. Performance of the separate consecutive inert and reductive phases, 20 and 30, allows easier separation of slag. Further, sulfur removal can be controlled better as the oxygen level of the blister copper is not lowered too early. Also, when liquid reduction agent is used, performance of the separate consecutive inert and reductive phases is beneficial. Furthermore, omission of the oxidation phase 20 of step (b) shortens the time required for the reduction phase 40 of step (d).

Accordingly, provided herein is a process as defined herein, comprising the steps of: (a) providing molten blister copper into an anode furnace; (b) oxidizing sulfur in the molten blister copper by blowing oxygen containing gas into the molten blister copper until a first prescribed target value has been reached; (c) subsequently lowering the sulfur and oxygen content in blister copper by blowing inert gas into the molten blister copper until a second prescribed target value has been reached and anode copper is obtained; and (e) directly after step (c) optionally casting the obtained anode copper.

Also, provided herein is a process as defined herein, comprising the steps of: (a) providing molten blister copper into an anode furnace; (c) directly after step (a) lowering the sulfur and oxygen content in blister copper by blowing inert gas into the molten blister copper until a second prescribed target value has been reached; (d) subsequently reducing oxygen in the blister copper by supplying a reducing agent into the molten blister copper until a third prescribed target value has been reached and anode copper is obtained; and (e) optionally casting the obtained anode copper.

In particular, provided herein is a as defined herein, comprising the steps of: (a) providing molten blister copper into an anode furnace; (b) oxidizing sulfur in the molten blister copper by blowing oxygen containing gas into the molten blister copper until a first prescribed target value has been reached; (c) subsequently lowering the sulfur and oxygen content in blister copper by blowing inert gas into the molten blister copper until a second prescribed target value has been reached; (d) subsequently reducing oxygen in the blister copper by supplying a reducing agent into the molten blister copper until a third prescribed target value has been reached and anode copper is obtained; and (e) optionally casting the obtained anode copper.

With reference to FIGS. 1 to 3, as a result of the present process of the present invention blister copper 1 obtained from a converting furnace is re-fined into copper of higher purity in the anode furnace i.e. anode copper 3. The molten anode copper 3 is then discharged from the anode furnace 100 and transferred through an anode launder to an anode casting mold and cast 60.

The composition of blister and anode copper, 1, 2*a* to 2*c*, and/or 3, can be monitored during the fire refining with methods known to a skilled person and the switching points between the phases may be determined by: measuring one or more of the parameters selected from the group consisting of sulfur and/or oxygen concentration from the blister copper; $SO_2$ concentration from the off-gas line, and optical monitoring of the off-gas composition, preferably oxygen concentration; comparing the measured value(s) of the parameter(s) with a predetermined reference value for the corresponding parameter; and when the predetermined reference value has been reached indicating that the next phase can be started and/or starting the next phase.

It will be obvious to a person skilled in the art that, as the technology advances, the inventive concept can be implemented in various ways. The invention and its embodiments are not limited to the examples described above but may vary within the scope of the claims.

The invention claimed is:

1. A process of fire refining blister copper, comprising the steps of:

(a) providing molten blister copper into an anode furnace;

(b) oxidizing sulfur in the molten blister copper by blowing oxygen containing gas into the molten blister copper until a first prescribed target value has been reached;

(c) subsequently discontinuing blowing of the oxygen containing gas and lowering a sulfur and oxygen content in blister copper by blowing inert gas into the molten blister copper until a second prescribed target value has been reached, wherein an inert phase (c) is continued until the second prescribed target value of an oxygen concentration is below 4000 ppm, and the second prescribed target value of a sulfur concentration is below 500 ppm;

(d) subsequently discontinuing blowing of the inert gas and reducing oxygen in the blister copper by supplying a reducing agent into the molten blister copper until a third prescribed target value has been reached and anode copper is obtained; and (e) optionally casting the obtained anode copper.

2. The process as claimed in claim 1, wherein an oxidation phase (b) is continued until the first prescribed target value of the sulfur concentration in the blister copper is from 400 to 1000 ppm.

3. The process as claimed in claim 1, wherein an oxidation phase (b) is continued until the first prescribed target value of the oxygen concentration in the molten blister copper is from 2000 to 5000 ppm.

4. The process as claimed in claim 1, wherein the inert gas is nitrogen.

5. The process as claimed in claim 1, wherein the inert phase (c) is continued until the second prescribed target value of the oxygen concentration is from 1500 to 2500 ppm.

6. The process as claimed in claim 1, wherein the inert phase (c) is continued until the second prescribed target value of the sulfur concentration is below 200 ppm.

7. The process as claimed in claim 1, wherein slag removal is performed at the end of an oxidation phase (b) and/or inert phase (c).

8. The process as claimed in claim 1, wherein a reduction phase (d) is continued until the third prescribed target value of the oxygen concentration is below 3000 ppm.

9. The process as claimed in claim 1, wherein a reduction phase (d) is continued until the third prescribed target value of the sulfur concentration is below 50 ppm.

10. The process as claimed in claim 1, wherein the composition of blister copper is monitored during the fire refining and switching points between phases is determined by: measuring one or more of the parameters selected from the group consisting of sulfur and oxygen concentration from the blister copper, $SO_2$ concentration from the off-gas line, and optical monitoring of the off-gas composition; comparing measured value(s) of the parameter(s) with a predetermined reference value for the corresponding parameter; and when the predetermined reference value has been reached indicating that a next phase can be started and/or starting the next phase.

11. The process as claimed in claim 1, wherein an oxidation phase (b) is continued until the first prescribed target value of the oxygen concentration in the molten blister copper is from 2100 to 3100 ppm.

12. The process as claimed in claim 1, wherein the inert phase (c) is continued until the second prescribed target value of the oxygen concentration is from 2000 to 2300 ppm.

13. The process as claimed in claim 1, wherein the inert phase (c) is continued until the second prescribed target value of the sulfur concentration is from 75 to 150 ppm.

14. The process as claimed in claim 1, wherein slag removal is performed after the inert phase (c).

15. The process as claimed in claim 1, wherein reduction phase (d) is continued until the third prescribed target value of the oxygen concentration is below 2300 ppm.

16. The process as claimed in claim 1, wherein reduction phase (d) is continued until the third prescribed target value of the oxygen concentration is from 500 to 1500 ppm.

* * * * *